US005297323A

United States Patent [19]

Jaeggi

[11] Patent Number: 5,297,323

[45] Date of Patent: Mar. 29, 1994

[54] DEVICE AND PROCESS FOR AUTOMATICALLY JOINING THREADS

[75] Inventor: Markus Jaeggi, Wattwil, Switzerland

[73] Assignee: Rhone-Poulenc Viscosuisse S.A., Emmenbrucke/Schweiz, Switzerland

[21] Appl. No.: 675,901

[22] PCT Filed: Sep. 19, 1989

[86] PCT No.: PCT/CH89/00172

§ 371 Date: May 9, 1991

§ 102(e) Date: May 9, 1991

[87] PCT Pub. No.: WO91/04217

PCT Pub. Date: Apr. 4, 1991

[51] Int. Cl.[5] ..... B65H 69/00; D04B 15/62

[52] U.S. Cl. ..... 28/211; 28/184; 289/2

[58] Field of Search ..... 28/184, 185, 194, 203.1, 28/204, 208, 209, 211, 214; 242/131, 131.1; 289/2, 18.1

[56] References Cited

U.S. PATENT DOCUMENTS

| | | | |
|---|---|---|---|
| 1,519,804 | 12/1924 | Sieber | 28/214 X |
| 2,544,435 | 3/1951 | Payne | 28/184 |
| 2,728,132 | 12/1955 | Shattuck et al. | 28/184 |
| 3,714,799 | 2/1973 | Minton | 66/145 S |
| 4,287,728 | 9/1981 | Schmid et al. | 66/145 S |
| 4,564,228 | 1/1986 | Kohlen | 289/18.1 X |
| 4,569,543 | 2/1986 | Kohlen et al. | 28/211 X |
| 4,645,248 | 2/1987 | Cottenceau et al. | 289/2 |

FOREIGN PATENT DOCUMENTS

| | | | |
|---|---|---|---|
| 807619 | 7/1951 | Fed. Rep. of Germany | 28/211 |
| 2831242 | 1/1980 | Fed. Rep. of Germany . | |
| 3336202 | 4/1985 | Fed. Rep. of Germany . | |
| 3620296 | 1/1987 | Fed. Rep. of Germany . | |
| 3619105 | 12/1987 | Fed. Rep. of Germany . | |
| 1558108 | 12/1979 | United Kingdom | 28/211 |

OTHER PUBLICATIONS

Stem, W., "New Bobbin Changer", Textile Horizons, Apr. 1988.

*Primary Examiner*—Clifford D. Crowder
*Assistant Examiner*—John J. Calvert
*Attorney, Agent, or Firm*—Felfe & Lynch

[57] ABSTRACT

A device for joining a large number of threads on a single frame. Each of a plurality of thread clamps has a guide tube communicating with a vacuum duct. A carriage for carrying a thread joining system is arranged on the frame. As the carriage moves along the frame to a selected position a thread clamp is released and the released thread is moved by a pivot threading arm to the joining system.

7 Claims, 3 Drawing Sheets

DEVICE AND PROCESS FOR AUTOMATICALLY JOINING THREADS

BACKGROUND OF THE INVENTION

The invention relates to a device for automatically joining threads, consisting of a frame with a plurality of thread clamps and a carriage which can be driven stepwise horizontally, on which a thread joining system is provided; it relates also to a process for joining threads, and to an application of the device.

The automatic changing of threads of a large number of spools mounted on a frame or spool rack is very important to efficient processing.

A device called a spool changer is known, which permits taking threads from 50 to 100 spools. It is used for the production of a tubular knit test sample which is composed of short sections corresponding to the number of installed spools (W. Stein, Textile Horizons, (1988) pages 40–42). The test stocking serves for visual inspection or as a sample for a colorimetric evaluation of the sections after it has been dyed.

Although the known automatic spool changer satisfies requirements in many cases, it has a number of disadvantages. For example, the number of threads is limited to no more than 96. Frequent thread breakage at the clamps interferes with the otherwise rapid change frequency.

SUMMARY OF THE INVENTION

The invention is addressed to the problem of making available an improved device for the automatic, reliable changing of a large number of threads from different spools and for their step-by-step joining.

According to the invention, a thread guide tube is associated with each thread clamp at a certain distance vertically above the thread puller, the tube being in communication with a vertically movable vacuum duct.

The thread is given a permanent bias tension by the vacuum until it is taken up for the thread draw-in, and cannot spring back or otherwise escape. The thread is best held by suction until it is released by a thread severing means.

The thread guide tubes are fastened in a rail, equipped at the end of the thread entrance with a thread guide eyelet, and consist preferably of ceramic tubes. This has the advantage that the thread is drawn in cleanly when suction is applied.

At the exit of the thread guide tubes rubber diaphragms, are applied, so that, when the vacuum duct is coupled to the thread guide tubes the suction power can be loss-free all the way to the intake opening of the thread guide tubes.

The segmented arrangement of the vacuum blocks has the advantage that a certain number of threads can be held under uniform tension and can be manipulated with less energy overall. Each suction block is equipped with an injector nozzle and a thread removal hose.

It is advantageous to provide a lifting jack and a lifting plate. The lifting plate has the advantage that, after the vacuum duct docks at the thread guide tubes, all the thread clamps are opened by the lifting plate, thereby permitting the general pulling through of the threads.

It is desirable to use as the threading arm an air jack disposed on a carriage, which is in communication with the vacuum duct, and can pick up the free thread end between the entrance to the thread guide tube and the thread clamp. The air jack closes the thread clamp prior to a position shift and does not release it until the threading arm is in the pickup position, in order to close the next clamp after the position shift. The pneumatic pickup and transport of the thread has proven to be more advantageous and reliable than a mechanical gripping arm.

The movement of the threading arm is best controlled by a template. The thread is best threaded into the threading arm by suction from an injector mounted at the exit.

On the carriage itself both a thread severing system and a thread marker are provided. The thread severing system cuts the "old" thread behind the splice after the splice has been completed.

After the run or pattern change the vacuum duct is docked at the thread guides. The term run or pattern change means replacement in a spool rack or creel with new spools. The thread ends cut from the old run and lying in range of the openings of the thread guide tubes are sucked up and, by the general release of the thread clamps, the new ends, which are tied to the old thread remnant, are brought by vacuum to the working position. After the vacuum duct is lowered and the thread clamps are set, the actual working process, changing process, is started. After the vacuum duct is docked at the thread guide tubes, therefore, all of the thread clamps are opened by the lifting plate. After the vacuum duct leaves the thread guide tubes, the thread clamps are actuated to prevent unthreading.

DETAILED DESCRIPTION OF THE PREFERRED EMBODIMENT

Figure 1:
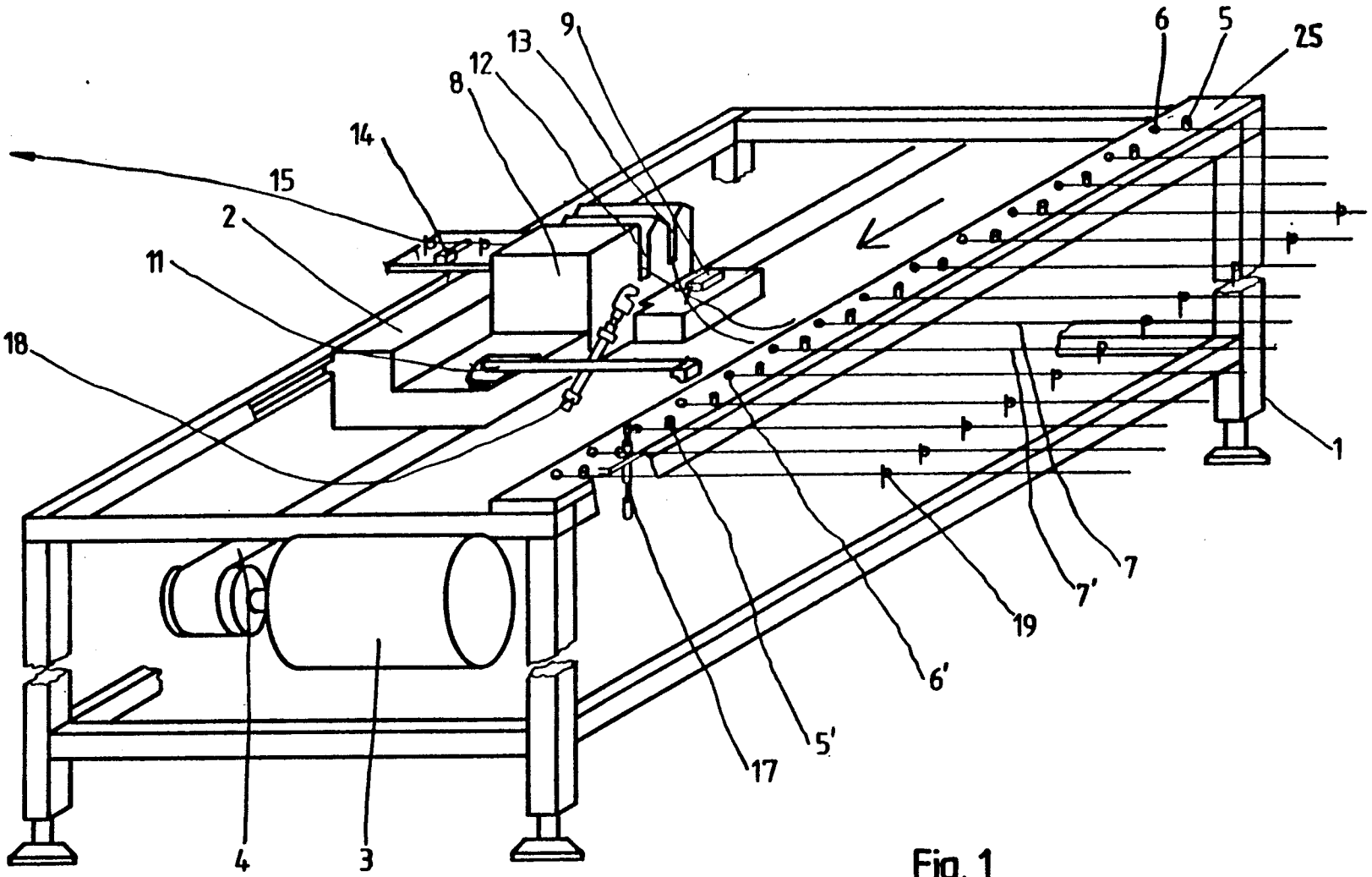
FIG. 1 is a perspective view of the apparatus in accordance with the invention.

In FIG. 1, a carriage 2 which can be driven by an electric motor 3 through a cogbelt 4 is provided on frame 1. In the frame 1 the thread clamps 5 and thread guide tubes 6 are disposed on rail member 25. Threads of which only threads 7, 7′ are marked, are stretched through thread guides 19, each from a spool on a spool rack (not shown). A thread joining device 8, a threading arm 11 and a thread detector 9 are disposed on the carriage 2. The thread joining device 8--a splicer in the present case--has a slot 12 and a slot 13. A thread 15 consists of the thread 7 and, after joining, thread 7′. A thread severing element 22 is provided for the release of the thread 7.

Figure 2:
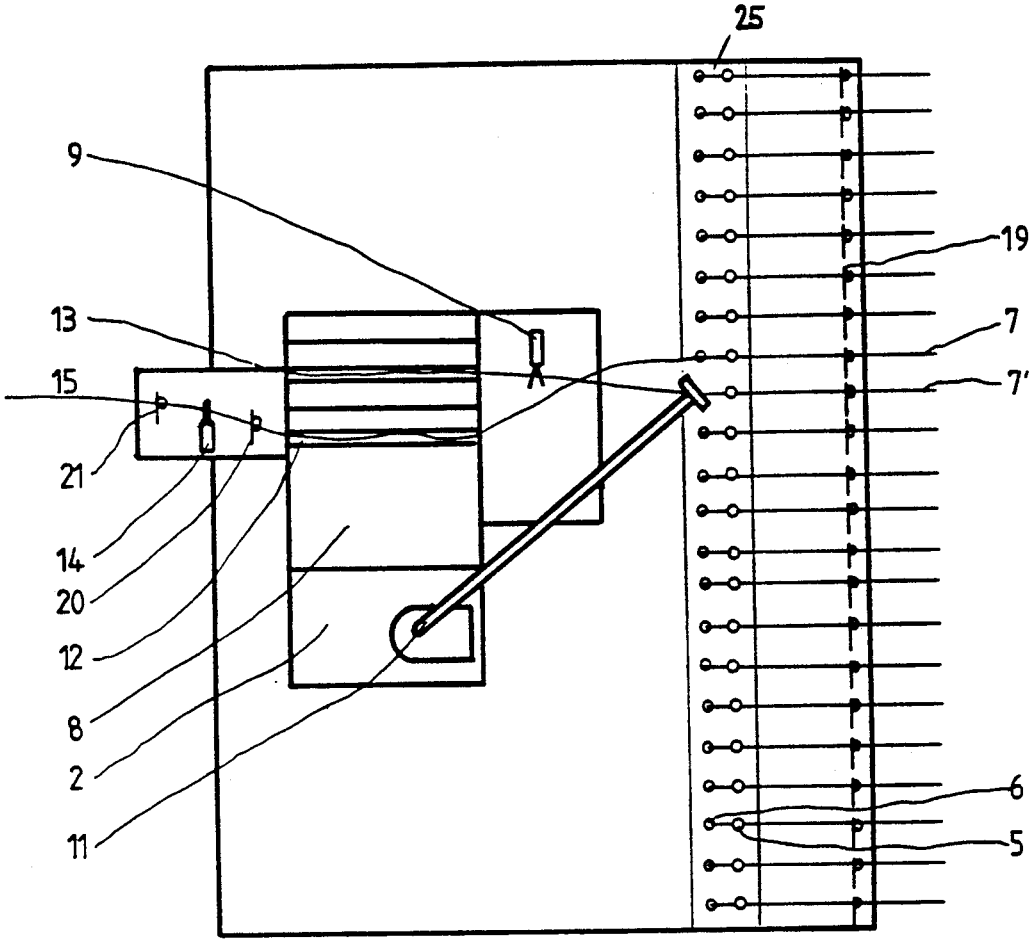
FIG. 2 is a top view of the apparatus

In FIG. 2, parallel threads coming from a spool rack are represented, and only threads 7 and 7′ are identified separately for clarity. The thread 7 is already joined to thread 15 and lies in slot 12. A new thread 7′ lies in slot 13 and is to be joined to thread 15. Thread 15 leads through thread guides 20 and 21, one ahead of and one behind the thread marker 14. The threading arm 11 is shown with its mouth among the thread guide tubes 6.

Figure 3:
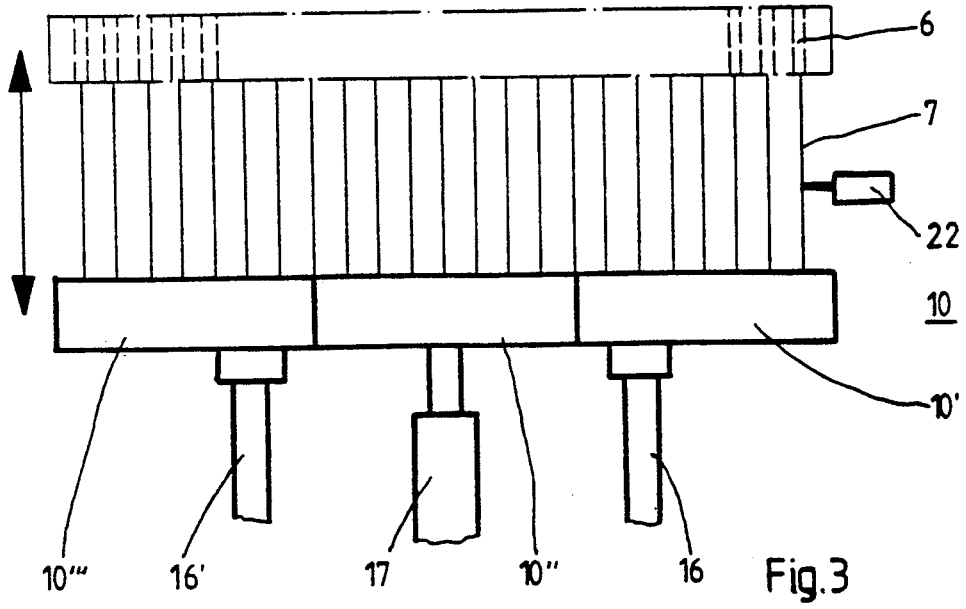
FIG. 3 shows a lowered position of the vacuum duct

In FIG. 3 are shown three sections, 10′, 10″ and 10‴ of the vacuum duct 10. Each of the sections 10′, 10″ and 10‴ is provided with an injector and a vacuum hose 16. For the sake of clarity only vacuum hoses 16 and 161 are shown for the sections 10′ and 10‴, respectively. A jack 17 with a flexible air hose, not shown, is associated with each vacuum duct 10. The vacuum duct 10 is displaceable vertically, as indicated by a double arrow. The thread severing element 22 serves to cut the threads 7 free. A soldering iron can serve as the thread severing element 22.

Figure 4:
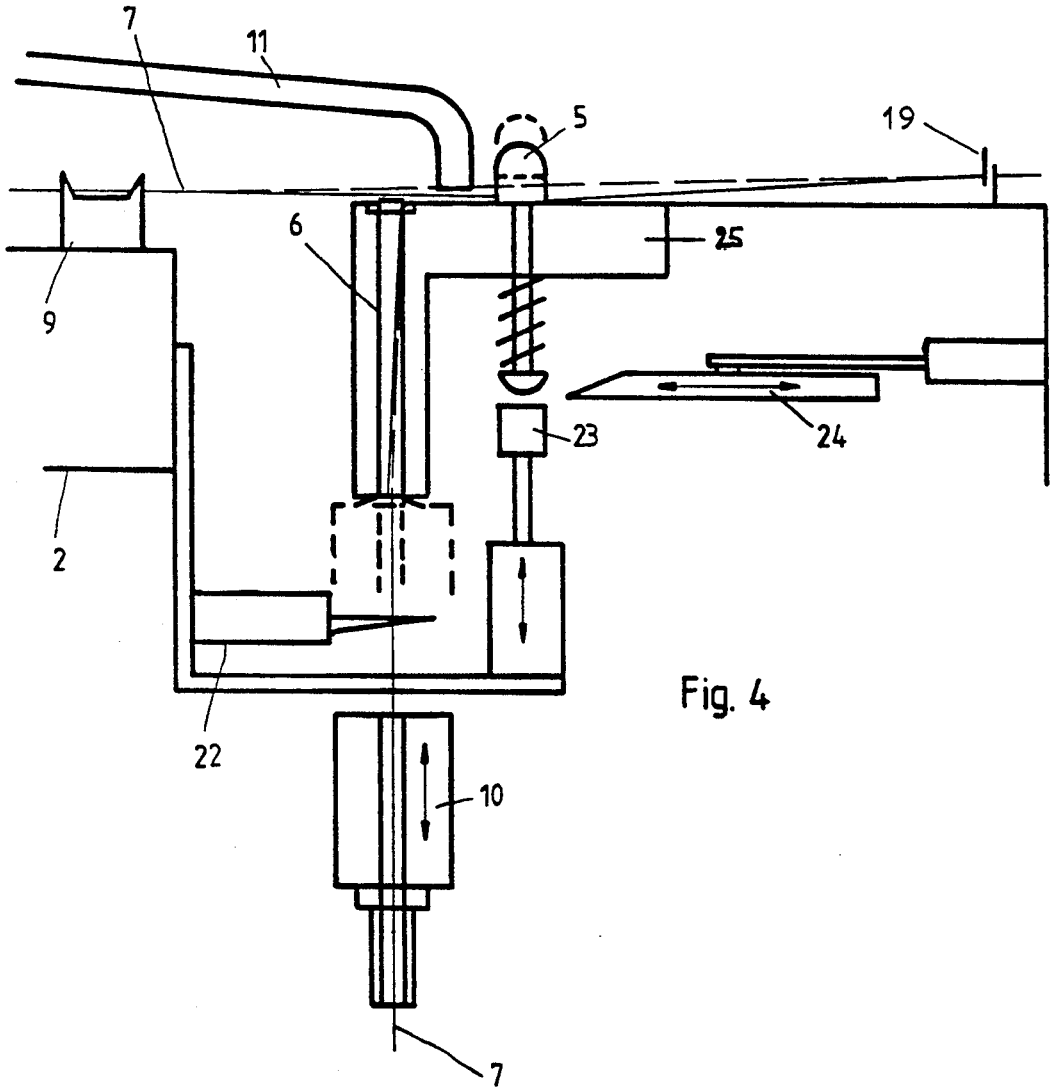
FIG. 4 is a detail of the apparatus according to FIG. 1.

The thread severing device 22 and lifting jack 23 fastened on the carriage 2 can be seen in FIG. 4. The threads 7 held by the vacuum duct 10 are released individually by the step-wise movement of the carriage 2. The released piece of thread can be sucked up by the threading arm 11. After the thread clamp 5 is opened by the jack 23, the threading arm 11 can lead the thread into the thread splicing device 8. The lifting jack 23 is provided for the actuation of one thread clamp 5; a lift-off plate 24 is provided for all thread clamps 5.

In operation, before start-up, all threads 7 are held by the thread clamps 5 and guided through the thread guide tubes 6. The free ends of the threads hang down by about 10 cm. The joined thread 15 passes through the thread joining device 8 and the thread marker 14 to a circular knitting machine, for example, not shown. When the apparatus starts up the threading arm 11 swings to the thread clamp 5 and the thread 7 is sucked up by the threading arm 11. The thread clamp 5 is pneumatically lifted by the jack 23; the thread 7 is drawn into the slot 12. At the same time the thread joining device 8, a thread splicer for example, is actuated and thus the thread front a spool rack is joined to the thread 15 of the knitting machine. The knitting machine is started and, after a given time, depending on the size of the desired section of goods, it is stopped again. At the same time the jack 23 is retracted and thus the thread 7 is again held by the thread clamp 5. The thread 7 is shifted by the thread raiser 18 from slot 12 to slot 13 and, after the threads are spliced, it is served by the thread severing device 22. The thread joining device 8 mounted on the carriage 2 is moved on by the motor 3 to the next thread station, and the cycle begins again with the thread 7'.

After all changing operations have ended the carriage 2 runs to the idle position. After the patterns are changed the automatic changer is started again. The vacuum duct 10 is raised and coupled to the thread guide tubes 6. The thread sections which lie more or less in order between the thread clamp 5 and the thread guide tube 6 are now drawn down into the thread guide tube 6. The lifting plate 24 opens all of the thread clamps 5, and the common pulling of all threads continues until all the joining locations are filled with old/new pattern. The lifting plate 24 is withdrawn. The thread clamps 5 are thus activated. The vacuum duct 10 is lowered, thereby making everything ready for the stepwise thread change. When the program is ended the carriage returns to the starting position.

The device according to the invention makes it possible to pull threads to selected lengths from a great number of spools without supervision. By the use of a splicer or knotter known in itself it is now for the first time possible to join together even more than 100 spools whose threads are presorted and placed in the device, depending on the size of the automatic machinery.

It is possible also to operate on the automatic machine with a number of spools less than the automatic machine design. The number of change positions can be preset for the automatic machine.

I claim:

1. Apparatus for automatically joining threads, comprising a frame having a rail member, a plurality of thread clamps linearly arranged on said rail member to receive a respective plurality of threads, a like plurality of thread guide tubes fixed to said rail member, each sad guide tube having a thread entry and a thread exit, said entries being linearly arranged adjacent respective said thread clamps, said exits being linearly arranged below said entries, a vacuum duct arranged for movement toward and away from said thread exits for drawing said threads through said guide tubes and maintaining a bias tension thereon, a carriage which is movable stepwise on said frame on a linear path parallel to sad rail member, a thread joining system on said carriage, means borne by said carriage for releasing an individual clamp, and a threading arm pivotably mounted on said carriage and having suction means which is pivotable between said rail and said thread joining system, whereby, upon moving said carriage to a preselected position, a thread may be drawn from a preselected guide tube by said suction means, and upon releasing the adjacent thread clamp, sad thread may be moved to the thread joining system by pivoting said threading arm.

2. Apparatus as in claim 1 wherein each said thread entry has a thread guide eyelet and each said thread exit has a rubber diaphragm which prevents los of vacuum in said guide tube when said exit is joined by said vacuum duct.

3. Apparatus as in claim 1 wherein said vacuum duct is divided into chambers.

4. Apparatus as in claim 1 further comprising means borne by said frame for releasing all clamps simultaneously.

5. Apparatus as in claim 1 further comprising a template mounted on said carriage for controlling vertical movement of said threading arm.

6. Apparatus as in claim 1 further comprising thread severing means mounted on said carriage.

7. Apparatus as in claim 1 further comprising thread marking means mounted on said carriage.

* * * * *